US009895567B2

(12) United States Patent
Lee

(10) Patent No.: US 9,895,567 B2
(45) Date of Patent: Feb. 20, 2018

(54) COMPREHENSIVE FITNESS EQUIPMENT LEG PRESS

(71) Applicant: Cha young Lee, Chungcheongnam-do (KR)

(72) Inventor: Cha young Lee, Chungcheongnam-do (KR)

( * ) Notice: Subject to any disclaimer, the term of this patent is extended or adjusted under 35 U.S.C. 154(b) by 0 days.

(21) Appl. No.: 15/422,406

(22) Filed: Feb. 1, 2017

(65) Prior Publication Data

US 2017/0136280 A1 May 18, 2017

Related U.S. Application Data

(63) Continuation of application No. PCT/KR2015/002605, filed on Mar. 18, 2015.

(30) Foreign Application Priority Data

Sep. 26, 2014 (KR) ..... 10-2014-0129077

(51) Int. Cl.
*A63B 21/00* (2006.01)
*A63B 21/008* (2006.01)
(Continued)

(52) U.S. Cl.
CPC ..... *A63B 21/008* (2013.01); *A63B 21/00072* (2013.01); *A63B 21/0083* (2013.01);
(Continued)

(58) Field of Classification Search
CPC ..... A63B 21/00058; A63B 21/00069; A63B 21/00072; A63B 21/00076;
(Continued)

(56) References Cited

U.S. PATENT DOCUMENTS 3,323,366 A * 6/1967 De Lorme, Jr. ..... A61B 5/224 482/138
5,314,390 A * 5/1994 Westing ..... A63B 21/00178 482/111
(Continued)

FOREIGN PATENT DOCUMENTS

JP 08-266683 A 10/1996
JP 3064659 U 1/2000
(Continued)

OTHER PUBLICATIONS

International Search Report dated Jun. 19, 2015 for PCT/KR2015/002605.

*Primary Examiner* — Andrew S Lo
*Assistant Examiner* — Gary D Urbiel Goldner
(74) *Attorney, Agent, or Firm* — Hauptman Ham, LLP

(57) ABSTRACT

The present invention relates to a comprehensive fitness equipment leg press that allows a user to do a weight training leg press exercise for training a lower body of the user by the user sitting on a bench and pushing a footrest included in a footrest frame, which moves back and forth smoothly along a central frame for adjusting a weight of the footrest frame. The comprehensive fitness equipment leg press includes a weight adjusting unit from 10 kg to 200 kg through a hydraulic cylinder formed on a lower end of the bench, without using 15 10 kg weights, and a hydraulic cylinder rod connection installed on a body of a weight adjusting bar using a principle of a lever for adjusting the weight of the footrest of the footrest frame.

5 Claims, 7 Drawing Sheets

(51) Int. Cl.

| | |
|---|---|
| ***A63B 21/055*** | (2006.01) |
| ***A63B 22/00*** | (2006.01) |
| ***A63B 23/035*** | (2006.01) |
| ***A63B 23/04*** | (2006.01) |
| ***A63B 71/00*** | (2006.01) |

(52) U.S. Cl.

CPC ..... *A63B 21/151* (2013.01); *A63B 21/154* (2013.01); *A63B 21/4029* (2015.10); *A63B 21/4034* (2015.10); *A63B 21/4035* (2015.10); *A63B 21/4045* (2015.10); *A63B 22/0017* (2015.10); *A63B 23/03525* (2013.01); *A63B 23/04* (2013.01); *A63B 23/0405* (2013.01); *A63B 21/0552* (2013.01); *A63B 2071/0063* (2013.01); *A63B 2225/09* (2013.01)

(58) Field of Classification Search

CPC ..... A63B 21/00178; A63B 21/00181; A63B 21/00185; A63B 21/002; A63B 21/0023; A63B 21/008; A63B 21/0083; A63B 21/0085; A63B 21/0087; A63B 21/012; A63B 21/018; A63B 21/02; A63B 21/04; A63B 21/0407; A63B 21/0414; A63B 21/0428; A63B 21/0435; A63B 21/0442; A63B 21/055; A63B 21/0552; A63B 21/0555; A63B 21/0557; A63B 21/0615; A63B 21/0616; A63B 21/0617; A63B 21/065; A63B 21/068; A63B 21/08; A63B 21/15; A63B 21/151; A63B 21/152; A63B 21/153; A63B 21/154; A63B 21/158; A63B 21/159; A63B 21/4027; A63B 21/4029; A63B 21/4031; A63B 21/4033; A63B 21/4034; A63B 21/4035; A63B 21/4039; A63B 21/4045; A63B 21/4047; A63B 21/4049; A63B 22/0015; A63B 22/0017; A63B 22/0046; A63B 22/0087; A63B 22/0089; A63B 23/035; A63B 23/03516; A63B 23/03525; A63B 23/04; A63B 23/0405; A63B 23/0417; A63B 23/047; A63B 23/0482; A63B 23/0494; A63B 2023/0411; A63B 69/0057; A63B 71/0054; A63B 2071/0063; A63B 2071/0072; A63B 2071/0081; A63B 2071/009; A63B 2208/0223; A63B 2208/0228; A63B 2208/0233; A63B 2225/09; A63B 2225/093; A63B 2244/09

See application file for complete search history.

(56) References Cited

U.S. PATENT DOCUMENTS

| | | | | | |
|---|---|---|---|---|---|
| 5,527,245 | A * | 6/1996 | Dalebout | A63B 21/00072 | 482/103 |
| 5,656,003 | A * | 8/1997 | Robinson | A63B 23/03525 | 482/100 |
| 5,890,996 | A * | 4/1999 | Frame | A63B 21/154 | 482/111 |
| 6,264,588 | B1 * | 7/2001 | Ellis | A63B 21/068 | 482/100 |
| 6,287,241 | B1 * | 9/2001 | Ellis | A63B 21/06 | 482/100 |
| 2003/0232703 | A1 * | 12/2003 | Webber | A63B 21/068 | 482/95 |
| 2004/0009855 | A1 * | 1/2004 | Webber | A63B 21/068 | 482/94 |
| 2015/0099608 | A1 * | 4/2015 | Ishii | A63B 21/0056 | 482/5 |

FOREIGN PATENT DOCUMENTS

| | | | |
|---|---|---|---|
| JP | 2006-000238 | A | 1/2006 |
| KR | 20-0451925 | Y1 | 1/2011 |
| KR | 20-2012-0005285 | U | 7/2012 |

* cited by examiner

COMPREHENSIVE FITNESS EQUIPMENT LEG PRESS

CROSS-REFERENCE TO RELATED APPLICATIONS

The present application is a continuation of International Patent Application No. PCT/KR2015/002605, filed on Mar. 18, 2015, which is based upon and claims the benefit of priority to Korea Patent Application No. 10-2014-0129077, filed on Sep. 26, 2014. The disclosures of the above-listed applications are hereby incorporated by reference herein in their entirety.

TECHNICAL FIELD

The present invention relates to fitness equipment for strengthening and developing muscle of various parts of the human body, and more specifically to weight lifting fitness equipment.

The present invention relates to a comprehensive fitness equipment leg press providing comprehensive fitness equipment enabling various workouts with one apparatus. The comprehensive fitness equipment leg press enables all family members to work out conveniently as well as to train muscle evenly of an entire human body for training various parts of the human body equally by regularly performing weight training, which is for vitalizing blood circulation and cardiopulmonary function, and increasing bone density of the human body.

In addition, the present invention relates to the comprehensive fitness equipment leg press which includes a weight adjusting unit from 10 kg to 200 kg through a hydraulic cylinder connection without use of weights, is in a compact size, and enables a user to simply adjust weight and to do leg press excise while sitting on a bench.

In addition, the present invention relates to the comprehensive exercise fitness equipment leg press enabling a user to exercise lower body with the weight adjusting unit which is capable of adjusting weight simply by using the principle of the lever, and is installed on the hydraulic cylinder connection connected to a hydraulic cylinder formed on a lower end of the bench in one body.

RELATED ART

Generally, in order to improve muscle strength and endurance, regular exercise is very important. But, modern people are too busy to exercise, so that they have a problem that the amount of their exercise is insufficient.

However, muscle strength exercise equipment so far has 12~15 10 kg weights which are positioned on one point, are connected to one another, and deliver weight to various exercise devices, so that the exercise equipment is excessively bulky and heavy, and has a problem that when an amount of user's muscle is increased and the user get used to the weight, the user wants to increase the weight and the weight can be increased by 10 kg, not by less than 10 kg, so that the user can be injured right after increasing the weight.

So far, comprehensive fitness equipment has 15 10 kg weights which are positioned on one point, are connected to one another, and deliver weight to various exercise devices, so that the exercise equipment is excessively bulky and heavy, and has a problem that the weight can be increased only by 10 kg, so that the user can be injured.

In addition, technical background of the present invention is shown in Korean utility model registration gazette No. 20-0451925 (Jan. 19, 2011).

In order to solve the problems described above, the purpose of the present invention relating to a comprehensive fitness equipment leg press is fine adjustment of weight suitable for user's physical strength by using a weight adjusting bar, in place of weights, coupled to a hydraulic cylinder connection with a fixing band and capable of adjusting weight from 10 kg to 200 kg. Also, another purpose of the present invention is to provide leg press fitness equipment and weight training equipment together which are in compact size, are capable of adjusting weight simply, and have a bench for the user to sit while working out.

The present invention is provided to achieve the purposes as described above, comprises: a footrest and a footrest frame are installed to move back and forth on a central frame connected to a front post frame and a rear post frame;

a weight adjusting bar is capable of adjusting tension of the footrest by being connected to an end of a wire having another end connected to the footrest frame installed on the central frame;

a hydraulic cylinder generates tension and is coupled to a portion of the weight adjusting bar with a fixing band;

a wire roller is installed on a portion of the rear post frame, maintains tension of the wire connecting the footrest and the weight adjusting bar, and guides the wire in accordance with movements of the footrest;

a rubber band is connected between the front post frame and weight adjusting bar in order to have tension in accordance with movements of the wire;

a handle is installed on the rear post frame in order to be held by a user while working out with feet on the footrest; a backrest is installed on an upper portion of the rear post frame having a backrest controller capable of controlling a distance between the back of the user and the footrest.

The present invention configured as described above, provides leg press fitness equipment enabling all family members to work out conveniently as well as to train muscle evenly of an entire human body for training various parts of the human body equally by regularly performing weight training, which is for vitalizing blood circulation and cardiopulmonary function, and increasing bone density.

The present invention provides a weight training effect to the user who can do a leg press exercise sitting on the bench with adjusting tension from 10 kg to 200 kg in accordance with physical condition and muscle exercise skillfulness by connecting the footrest frame capable of moving back and forth smoothly and the weight adjusting bar with the wire. The weight adjusting bar is capable of adjusting weight simply by using the principle of levers and is installed on a hydraulic cylinder connection connected to a hydraulic cylinder formed on a lower end of the bench in one body without using 15 10 kg weights.

DETAILED DESCRIPTION

Figure 1:
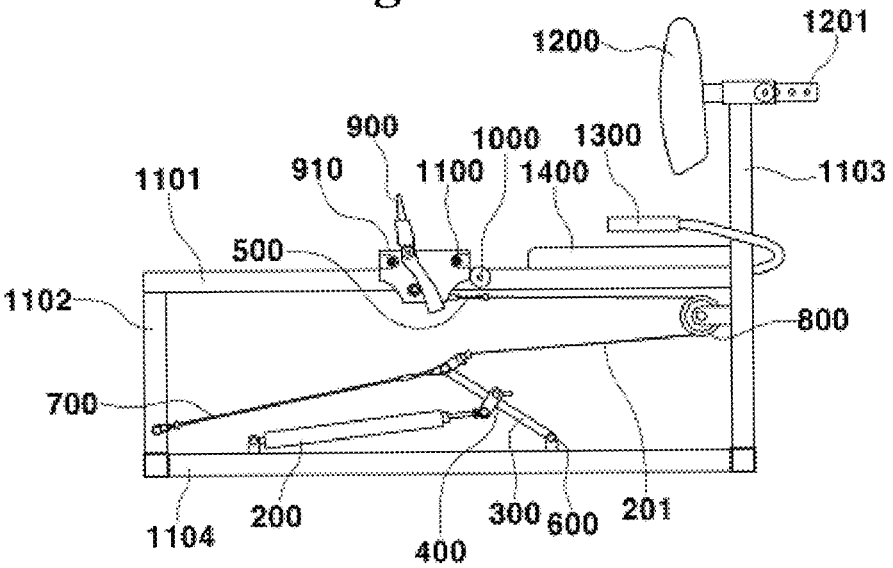
FIG. 1 shows a right side view of a leg press, fitness equipment of the present invention.

Hereinafter, technical configuration of the present invention is described in detail referring to the drawings attached.

FIG. 1 shows a right side view of a leg press, fitness equipment of the present invention, a footrest (910) having a footrest frame (900) installed to move back and forth on a central frame (1101) connected to a front post frame (1102) and a rear post frame (1103) is installed.

An end of a wire (201) is connected to the footrest frame (910) having the footrest (900) installed on the central frame (1101), and another end of the wire (201) is connected to an upper end of a weight adjusting bar (300) capable of adjusting tension of the footrest (910).

An end of a rod of the hydraulic cylinder (200) is coupled to a portion of the weight adjusting bar (300) in length direction thereof with a fixing band (400) to generate tension on the wire (201) connected to the footrest frame (910).

A wire roller (800) is installed on a side of the rear post frame (1103), and guides the wire (201) in accordance with movement of the footrest frame (910) to keep the wire (201) tight. The wire (201) connects the footrest frame (910) and the weight adjusting bar (300).

The weight adjusting bar (300) moves like a lever to generate tension in accordance with movement of the wire (201) by connecting a rubber band (700) between the front post frame (1102) and the weight adjusting bar (300) for generating elastic tension.

A handle (1300) is installed on the rear post frame (1103) in order to be held by a user while working out with feet on the footrest (900).

In addition, a backrest (1200) having a backrest controller (1200) is installed on an upper end of the rear post frame (1103) for controlling a distance of the footrest (900) in accordance with a length of feet of a user.

Figure 2:
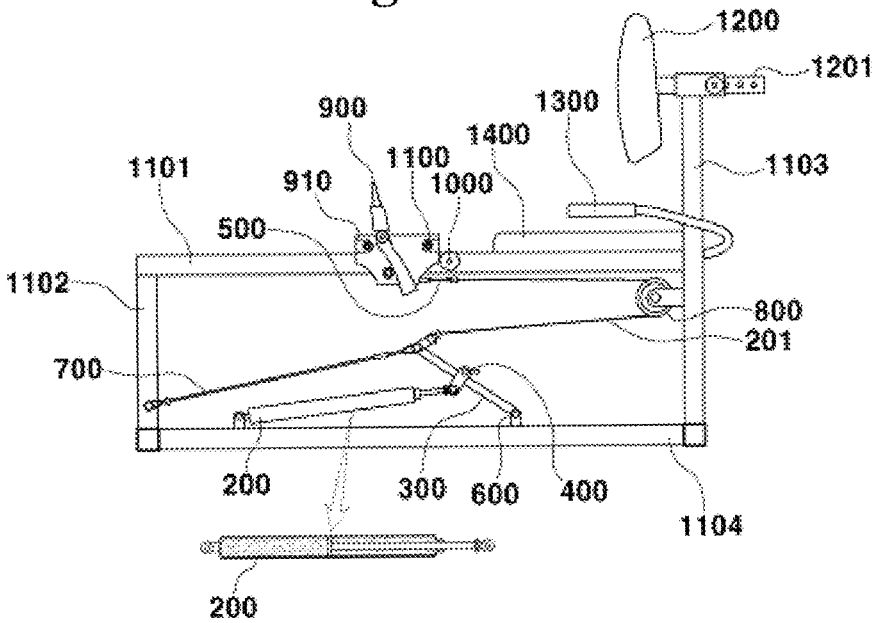
FIG. 2 shows a sectional view of the hydraulic cylinder installed on the leg press, the fitness equipment of the present invention.
Figure 3:
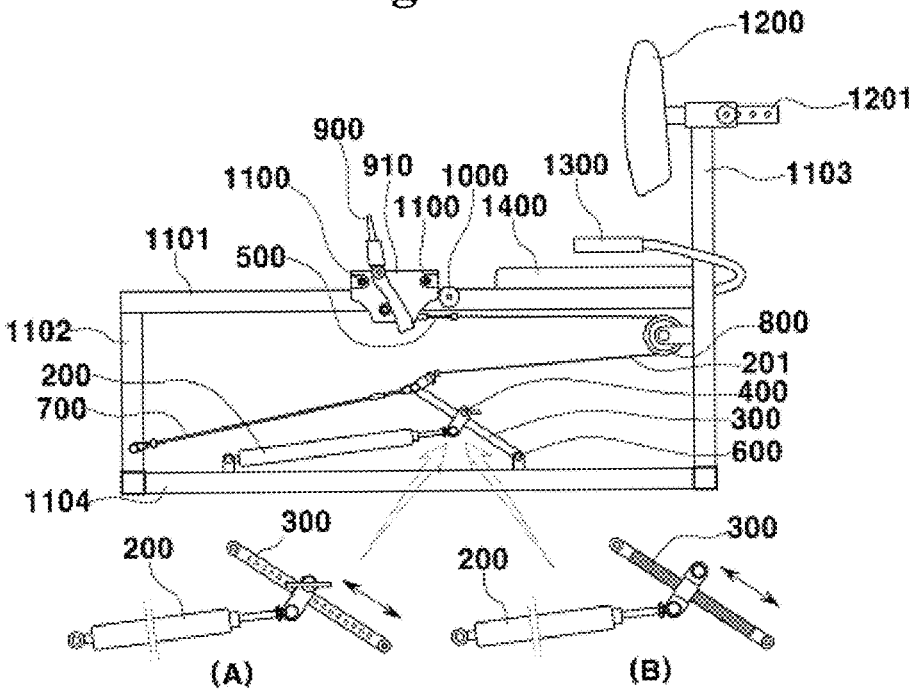
FIG. 3 shows an exemplary view of example (A) and (B) of a weight adjusting bar connected to the hydraulic cylinder in the leg press, the fitness equipment of the present invention.
Figure 4:
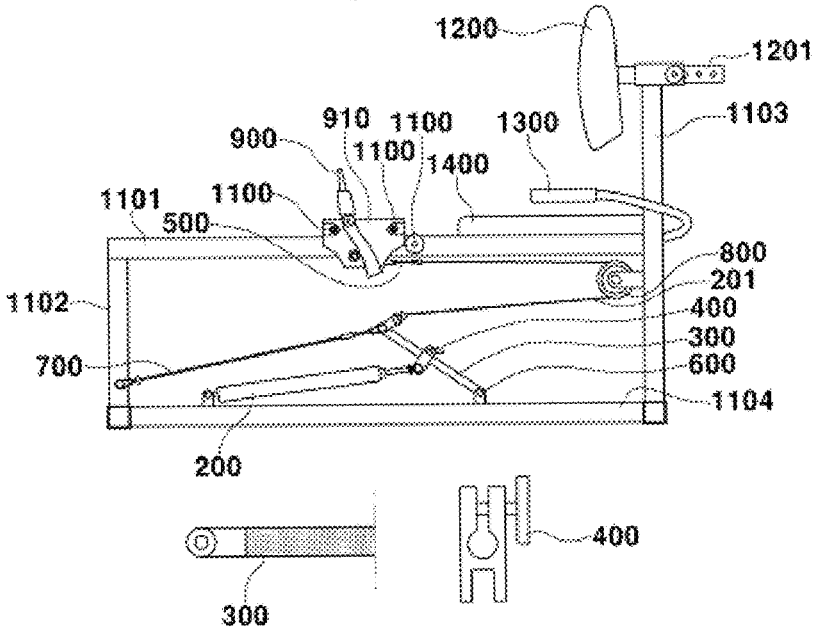
FIG. 4 shows a fixing band capable of adjusting tension by coupling the weight adjusting bar and the hydraulic cylinder of the leg press, the fitness equipment of the present invention.

FIG. 2 shows a sectional view of the hydraulic cylinder installed on the leg press, the fitness equipment of the present invention, FIG. 3 shows a exemplary view of example (A) and (B) of a weight adjusting bar connected to the hydraulic cylinder in the leg press, the fitness equipment of the present invention, and FIG. 3 shows a exemplary view of example (A) and (B) of a weight adjusting bar connected to the hydraulic cylinder in the leg press, the fitness equipment of the present invention. A side of the hydraulic cylinder (200) is installed on a lower frame (1104) installed on a lower portion between the front post frame (1102) and the rear post frame (1103), a rod of the hydraulic cylinder (200) is coupled to the weight adjusting bar (300) by the fixing band (400).

FIG. 2 shows a sectional view of the hydraulic cylinder installed on the leg press, the fitness equipment of the present invention, hydraulic cylinder (200) of the present invention has an optimized hydraulic oil pressure controlled for 200 kg of usual weights of fitness equipment, and the fixing band (400) is installed on a connection of the rod of the hydraulic cylinder (200) to be coupled to the weight adjusting bar (300).

The fixing band (400) is coupled to the weight adjusting bar (300), but tension of the wire (201) differs depending on a position of the fixing band (400) installed on the weight adjusting bar (300), so that the tension differs when the footrest frame (910) having the footrest (900) moves back and forth.

Thus, the present invention provides a basic technical configuration that a user may do leg press exercise with weight, as a user wants, up to 200 kg.

In addition, as shown in FIG. 3 (A), the fixing band (400) installed on an upper portion of the rod of the hydraulic cylinder (200) is pin-type-coupled to one of openings formed on the weight adjusting bar (300) in a length direction for controlling tension in accordance with position of the opening coupled to the fixing band (400), in another way, as shown in FIG. 3 (B), embossing portion is formed on an exterior of the weight adjusting bar (300) for having friction force when the fixing band (400) is coupled, so that the tension is controlled by the position of the fixing band (400) coupled to the weight adjusting bar (300).

As shown in FIG. 3, the weight adjusting bar (300) may be manufactured in two types of A type and B type using the principle of the lever, the B type is capable of adjusting weight by 1 mm, and another A type is capable of adjusting weight in accordance with the position of the openings formed at regular intervals, so that the weight adjusting unit, as consumers want, is manufactured and sold to the consumers.

The fixing band (400) is to adjust weight, is formed of synthetic resin, is formed of a material having a strength of a bullet-proof material, and is durable, lightweight, easy and convenient to adjust weight, and capable of adjusting weight by 1 mm.

Figure 5:
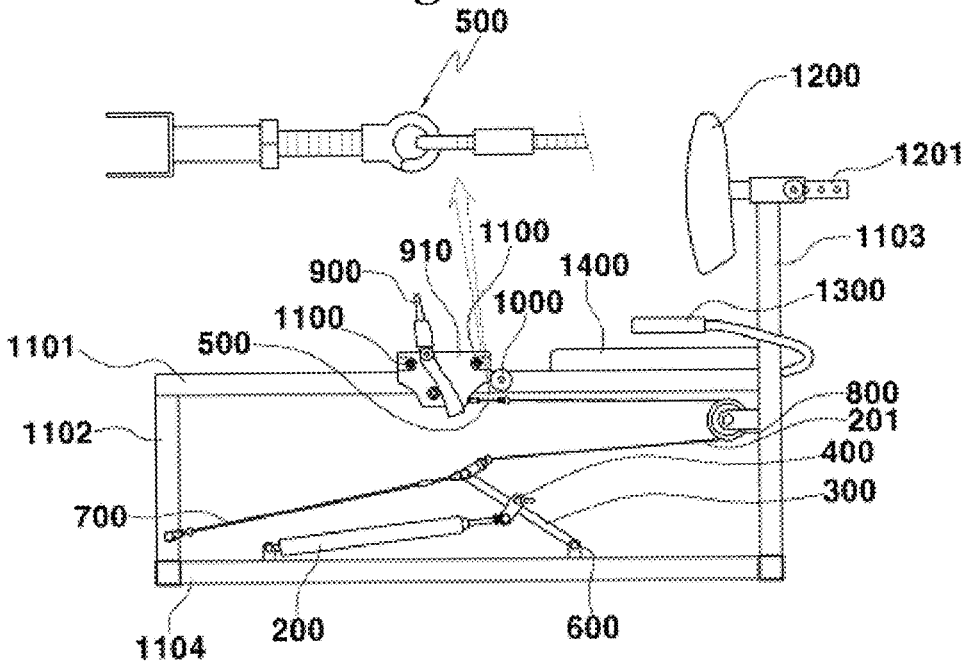
FIG. 5 shows a wire adjusting unit capable of adjusting a length of the wire of the leg press, the fitness equipment of the present invention.

FIG. 5, shows a wire adjusting unit capable of adjusting a length of the wire of the leg press, the fitness equipment of the present invention, the wire adjusting unit (500) is installed on the wire (201) connected between the footrest frame (910) and the weight adjusting bar (300), and controls a length of the wire (201) minutely.

Figure 6:
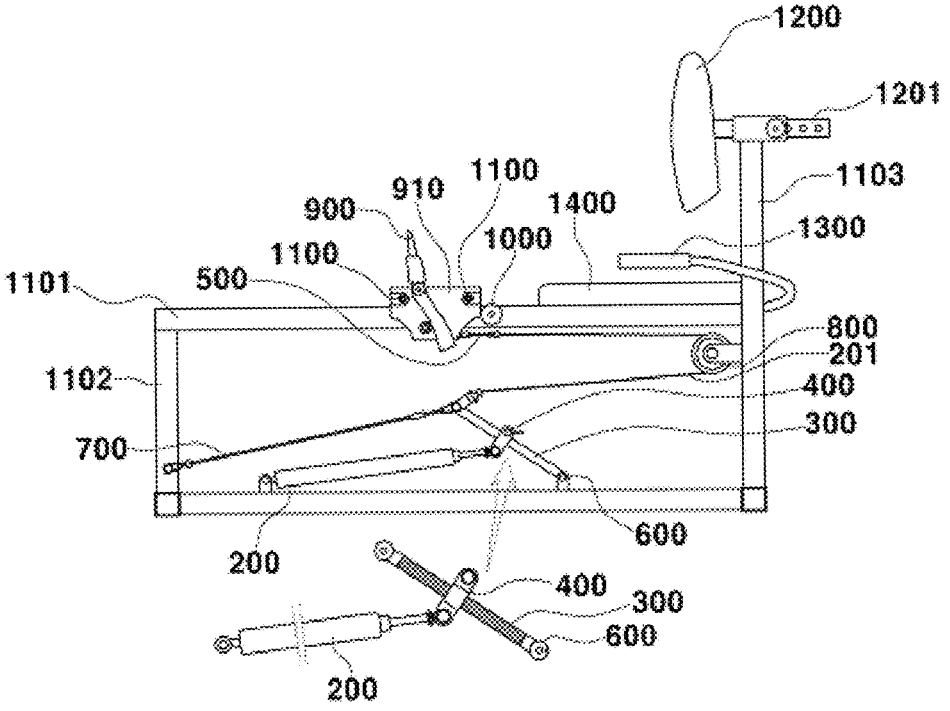
FIG. 6 shows a noise prevention bearing comprised of joints on opposite sides of the weight adjusting bar of the leg press, the fitness equipment of the present invention.

FIG. 6 shows a noise prevention bearing comprised of joints on opposite sides of the weight adjusting bar of the leg press, the fitness equipment of the present invention, the bearing (600) has a joint function for the weight adjusting bar (300) having a lever function when weight adjustment of the footrest frame (910), and is wedged not to spin, and the same technology is applied on all joints.

A lower portion of the weight adjusting bar (300) is combined to the bearing (600) installed on the lower frame (1104) for smooth reciprocation of the weight adjusting bar (300).

Figure 7:
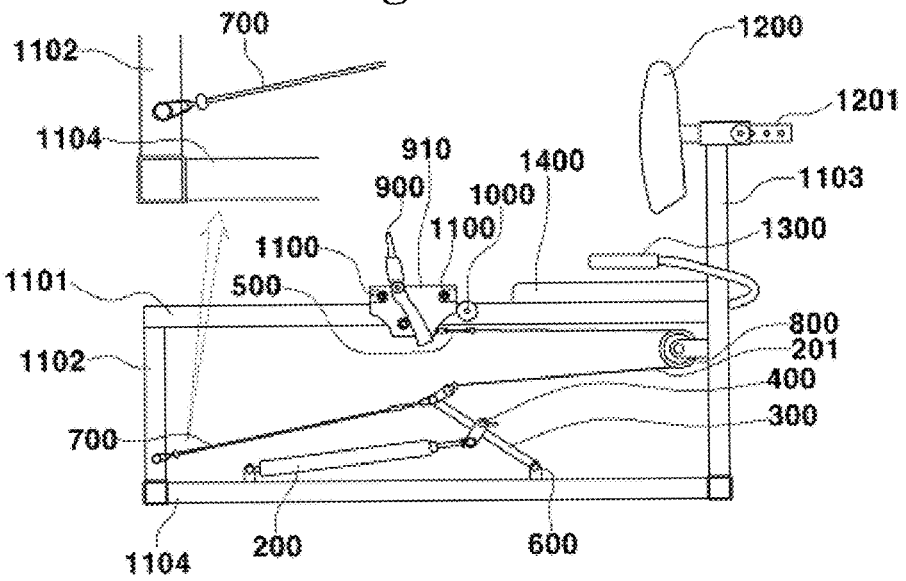
FIG. 7 shows a rubber band delivering tension to the wire and the weight adjusting bar of the leg press, the fitness equipment of the present invention.

FIG. 7 shows the rubber band delivering tension to the wire and the weight adjusting bar of the leg press, the fitness equipment of the present invention, the rubber band (700) enables the weight adjusting bar (300) to reciprocate right and left, formed of a thin rubber band, and has 20 thin rubber bands woven by nylon threads.

An end of an upper portion of the weight adjusting bar (300) is connected to the wire (201) and another end of the upper portion of the weight adjusting bar (300) is connected to the rubber band (700) connected to the front post frame (1102).

Figure 8:
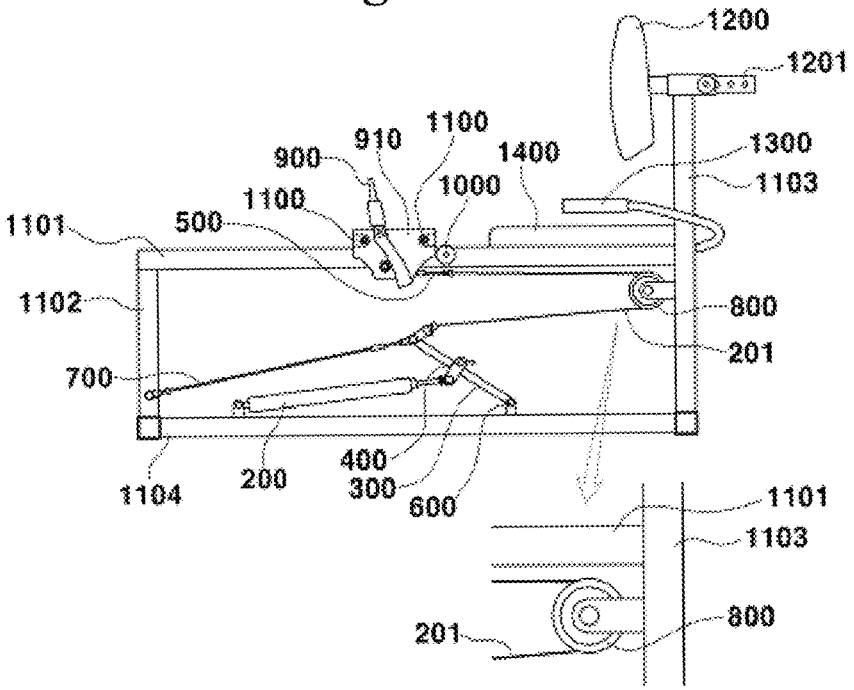
FIG. 8 shows a wire roller guiding the wire of the leg press, the fitness equipment of the present invention.

FIG. 8 shows a wire roller guiding the wire of the leg press, the fitness equipment of the present invention, the wire roller (800) is installed on a lower portion of a handle inside the rear post frame (1103) to guide the wire (201), and is installed in parallel with the footrest frame (910) installed on the central frame (1101) for smooth reciprocation of the weight adjusting bar (300) when the wire (201) moves.

Figure 9:
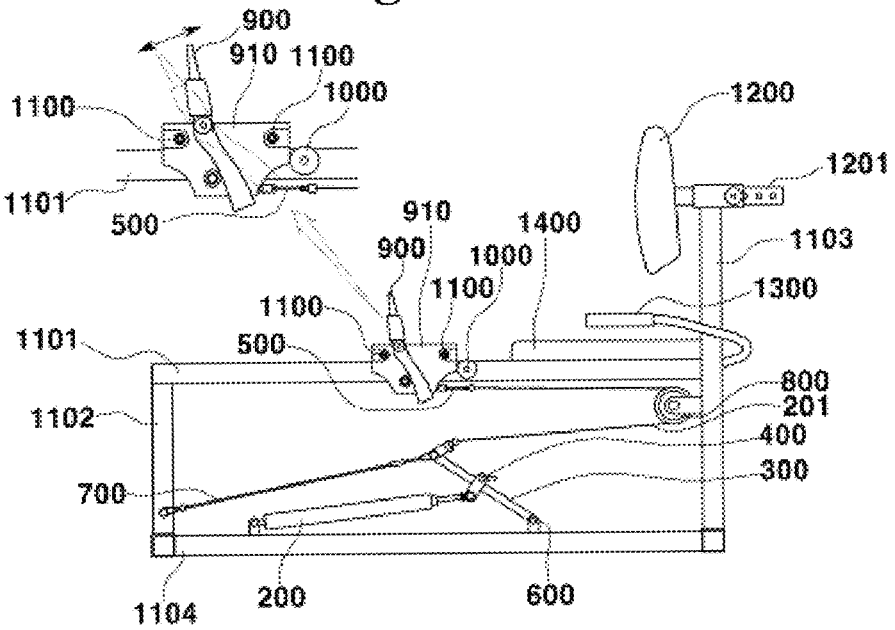
FIG. 9 shows a footrest moving back and forth on the central frame of the leg press, the fitness equipment of the present invention.

FIG. 9 shows the footrest moving back and forth on the central frame of the leg press, the fitness equipment of the present invention, footrest (900) is installed on the ball bearings (1100) formed on opposite sides of the footrest frame (910) to be moved by angle of feet of the user.

Figure 10:
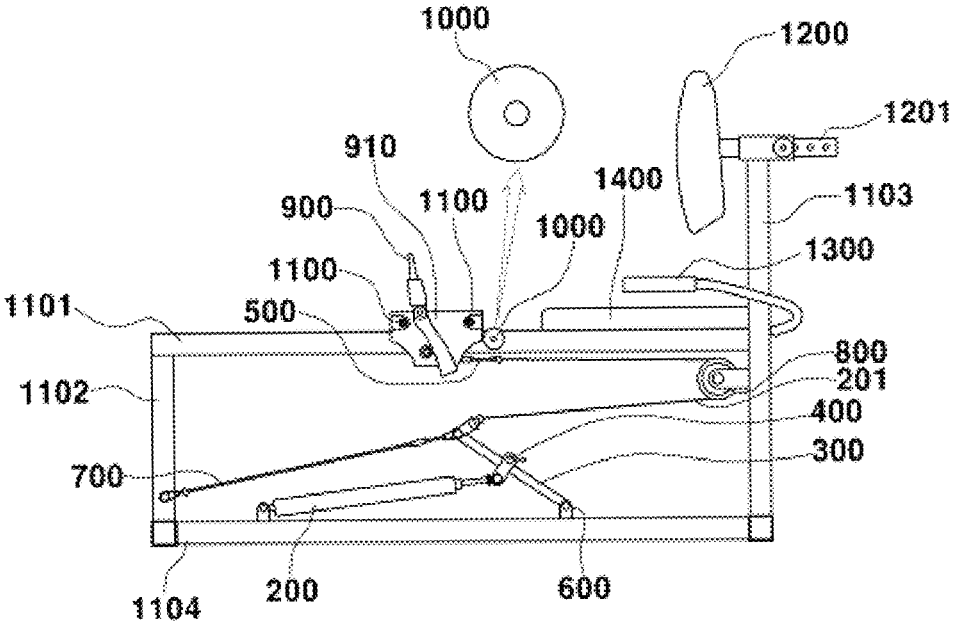
FIG. 10 shows a footrest frame buffer unit, a fixing stopper of the footrest frame moving back and forth on the central frame of the leg press, the fitness equipment of the present invention.

FIG. 10 shows a footrest frame buffer unit, a fixing stopper of the footrest frame moving back and forth on the central frame of the leg press, the fitness equipment of the present invention, the footrest frame buffer unit (1000) of the footrest frame (910) is installed on the central frame (1101) at a position that the footrest frame (910) finally returns back on the central frame (1101).

The footrest frame buffer unit (1000) is formed of circular thick rubber and fixed on a side of the central frame (1101) not to move for preventing noise.

Figure 11:
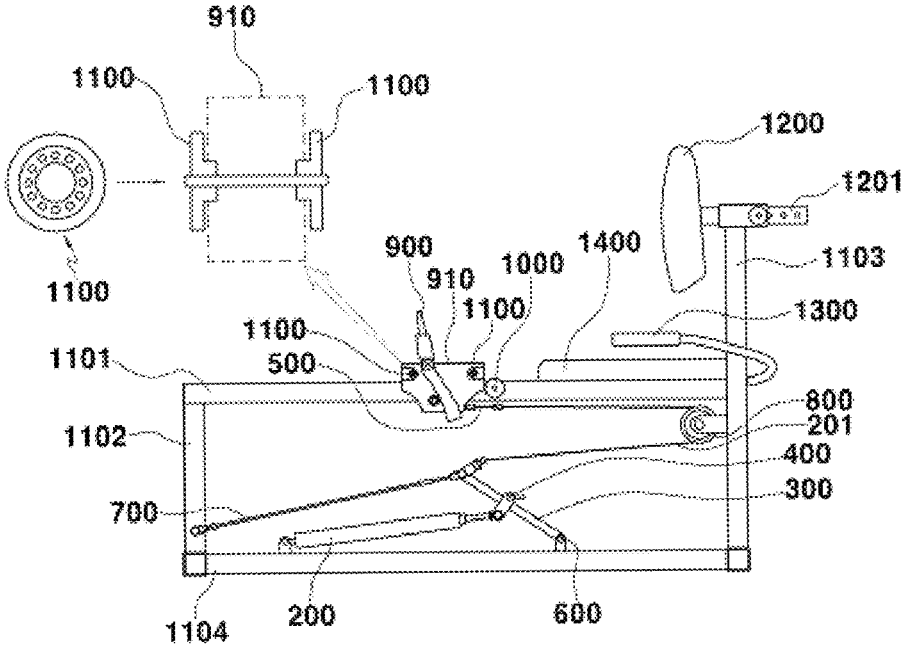
FIG. 11 shows a ball bearing installed on the footrest frame of the leg press, the fitness equipment of the present invention.

FIG. 11 shows the ball bearing installed on the footrest frame of the leg press, the fitness equipment of the present invention, the ball bearings (1100) is formed of metal, is installed on opposite sides of the footrest frame (910), and is formed by PVC injection, so that a portion of the ball bearing (1100) is protruded.

The footrest (900) surrounds upper and lower portion of the central frame (1101) to ensure strong and smooth reciprocation without noise.

Figure 12:
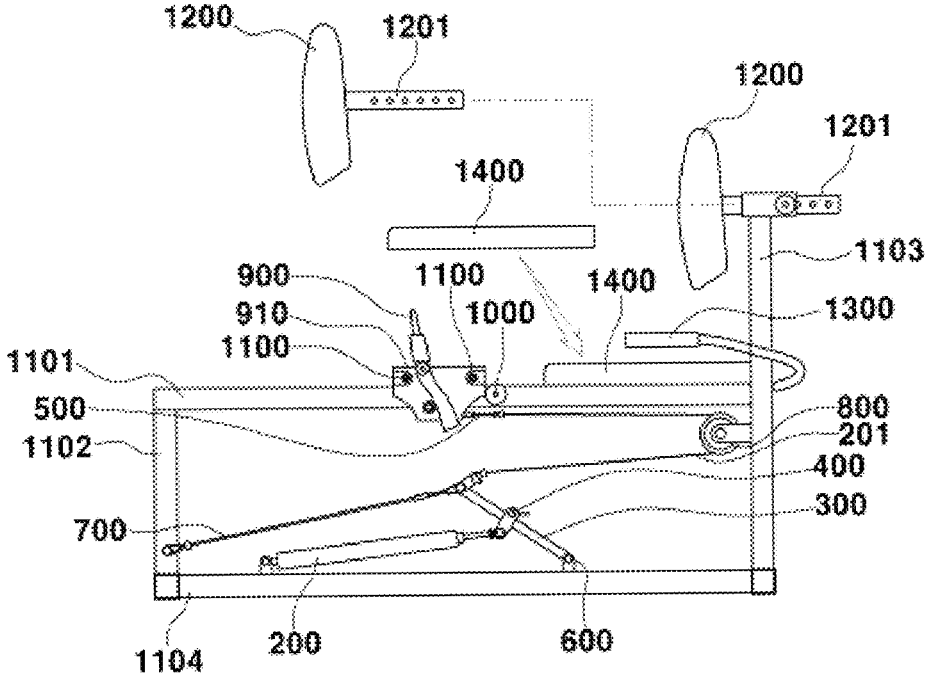
FIG. 12 shows a backrest with a distance control function in accordance with physical conditions of the user using the leg press, the fitness equipment of the present invention.

FIG. 12 shows the backrest with a distance control function in accordance with physical conditions of the user using the leg press, the fitness equipment of the present invention, the backrest (1200) is installed on an upper portion of the rear post frame (1103) and has the backrest controller (1200) which controls a distance between the backrest (1200) and the footrest (900) in accordance with a length of feet of the user.

The backrest controller (1200) moves back and forth and includes a fixing unit which is easy and convenient one-touch type.

Figure 13:
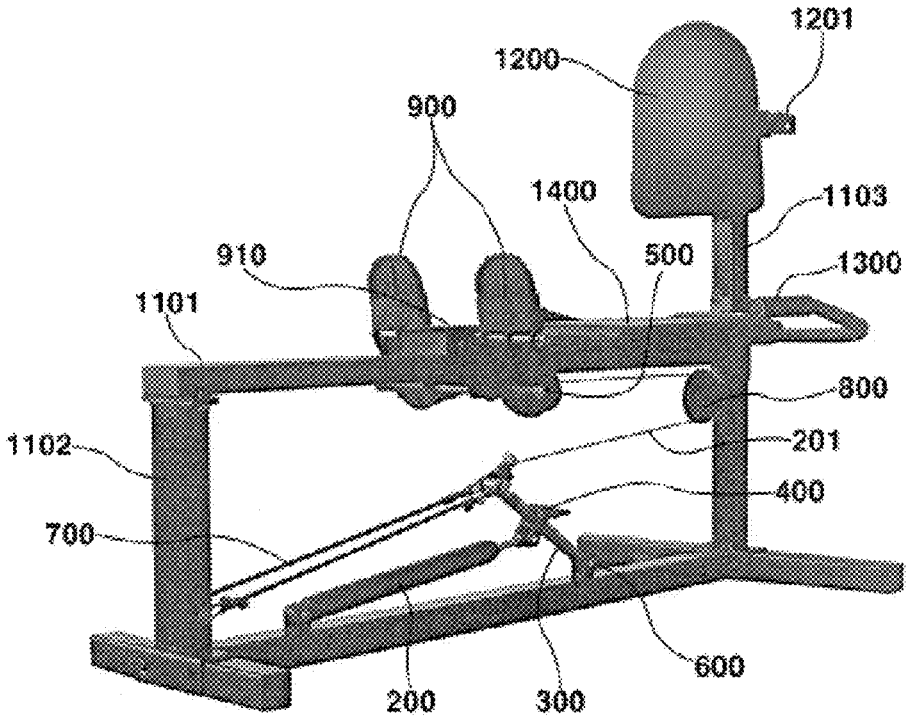
FIG. 13 shows a perspective view of the entire leg press, the fitness equipment of the present invention.

FIG. 13 shows a perspective view of the entire leg press, the fitness equipment of the present invention, entire elements of the leg press are described in accordance with symbols in each drawing from FIG. 1 to FIG. 12 in order to avoid duplication of previous description.

Like descriptions above, the present invention provides advantages enabling all family members to work out conveniently as well as to train muscle evenly of an entire human body for training various parts of the human body equally by regularly performing weight training, which is for vitalizing blood circulation and cardiopulmonary function, and increasing bone density.

What is claimed is:

1. A comprehensive fitness equipment leg press comprising:

a footrest and a footrest frame installed to move back and forth on a central frame connected to a front post frame and a rear post frame;

a weight adjusting bar configured to adjust tension of the footrest by being connected to an end of a wire, the wire having another end connected to the footrest frame installed on the central frame;

a hydraulic cylinder configured to generate the tension and coupled to a portion of the weight adjusting bar with a fixing band;

a wire roller installed on a side of the rear post frame, and configured to guide the wire in accordance with movement of the footrest frame to keep the wire tight, which connects the footrest frame and the weight adjusting bar;

a rubber band connected between the front post frame and weight adjusting bar in order to have the tension in accordance with movements of the wire;

a handle installed on the rear post frame and configured to be held by a user while working out with feet on the footrest; and a backrest installed on an upper portion of the rear post frame and including a backrest controller being capable of controlling a distance between the backrest and the footrest.

2. The comprehensive fitness equipment leg press of claim 1, wherein the backrest controller is one-touch type controllable and controls the distance between the backrest and the footrest in accordance with a length of the legs of the user.

3. The comprehensive fitness equipment leg press of claim 1, wherein an end of an upper portion of the weight adjusting bar is connected to the wire and another end of the upper portion of the weight adjusting bar is connected to the rubber band connected to the front post frame, and wherein a lower portion of the weight adjusting bar is coupled to a bearing installed on a lower frame for smooth reciprocation of the weight adjusting bar.

4. The comprehensive fitness equipment leg press of claim 1, wherein the fixing band is installed on an upper portion of a rod of the hydraulic cylinder and is pin-type-coupled to one of a plurality of openings formed on the weight adjusting bar in a length direction for controlling the tension in accordance with a position of the one of the plurality of openings coupled to the fixing band.

5. The comprehensive fitness equipment leg press of claim 1, wherein an embossing portion is formed on an exterior of the weight adjusting bar for having a friction force when the fixing band is coupled to the weight adjusting bar.

* * * * *